US005992680A

United States Patent [19]

Smith

[11] Patent Number: 5,992,680

[45] Date of Patent: Nov. 30, 1999

[54] SLIDABLE SEALING LID APPARATUS FOR SUBSURFACE STORAGE CONTAINERS

[76] Inventor: Philip E. Smith, 3737 Electro Way, Redding, Calif. 96002

[21] Appl. No.: 08/790,911

[22] Filed: Jan. 29, 1997

Related U.S. Application Data

[60] Provisional application No. 60/010,707, Jan. 29, 1996.

[51] Int. Cl.[6] ..... B65D 43/14

[52] U.S. Cl. ..... 220/812; 220/816

[58] Field of Search ..... 49/221, 216, 211, 49/209; 220/329, 331, 260, 262, 263, 252, 345, 908, 811, 812, 816, 820, 823, 827, 828, 831; 215/322, 235, 236

[56] References Cited

U.S. PATENT DOCUMENTS

| | | | |
|---|---|---|---|
| 2,338,477 | 1/1944 | Wolters et al. | 220/331 |
| 4,320,852 | 3/1982 | Nagelkirk | 220/812 |
| 4,821,902 | 4/1989 | May | 220/329 X |
| 4,878,596 | 11/1989 | Cawley et al. | 220/812 |
| 5,644,803 | 7/1997 | Wilson | 220/811 X |

*Primary Examiner*—Joseph M. Moy
*Attorney, Agent, or Firm*—John P. O'Banion

[57] ABSTRACT

A container lid apparatus having a plurality of support brackets which are pivotally mounted in a base. A rod is pivotally mounted to ends of the support brackets, and a plurality of rollers are rotatably mounted on the rod. A container lid is provided which includes a plurality of runners which engage the plurality of rollers. The support brackets pivot from a closed position to an open position wherein the container lid is slightly raised from the container opening. While in the open position, the container lid is rolled on the rollers away from the container opening to provide access to the container.

10 Claims, 5 Drawing Sheets

SLIDABLE SEALING LID APPARATUS FOR SUBSURFACE STORAGE CONTAINERS

CROSS-REFERENCE TO RELATED APPLICATIONS

This application is related to and claims the priority of co-pending U.S. provisional application Ser. No. 60/010,707 filed on Jan. 29, 1996.

BACKGROUND OF THE INVENTION

1. Field of the Invention

This invention pertains to lids and covers for containers, and more particularly to a container lid apparatus for sub-ground or subsurface containers or tanks.

2. Description of the Background Art

Tanks, drainage systems, storage containers, and like structures are frequently placed below ground or beneath floors for convenience and to economize space. Access to such containers is usually provided by a lid mounted in the top of the container at the ground or floor level. Lids for such containers must generally be made of durable, heavy construction to support the weight of persons or vehicles when the lid is in place on the container.

A common problem with container lids for subsurface containers and tanks is that the heavy construction of the lids makes it difficult to remove or open the lids to gain access to the containers. Additionally, the weight of the lids creates a risk of injury to persons handling them. Currently known hinge mechanisms for heavy, ground or floor-mounted lids experience frequent failure and do not effectively facilitate the opening and closing of the lids.

Accordingly, there is a need for a container lid suitable for use with sub-ground or sub-floor containers which provides for quick and easy opening and closing of the lid, which eliminates the risk of injury associated with moving heavy lids, and which includes a hinge assembly that is not prone to fatigue and failure. The present invention satisfies these needs, as well as others, and generally overcomes the deficiencies found in the background art.

SUMMARY OF THE INVENTION

The present invention pertains to a container lid apparatus which allows quick and easy opening and closing of heavy ground or floor mounted lids. In general terms, the invention comprises a plurality of support brackets pivotally mounted onto a base and pivotally coupled to rollers or a roller assembly. The rollers engage tracks on a container lid. A pneumatic cylinder is pivotally mounted to the base. A brace is pivotally coupled to at least one of the support brackets, and a plunger of the pneumatic shock absorber cylinder is pivotally coupled to the brace.

By way of example and not of limitation, a pair of generally J-shaped support brackets are used with the invention, with a first end of each support bracket pivotally coupled to the base and a second end of each support bracket coupled to a roller. The pneumatic cylinder is pivotally coupled to the base at a first end, and the plunger is slidably disposed within the pneumatic cylinder and extends from a second end of the cylinder. The brace is pivotally coupled at a first end to one of the support brackets, and is pivotally coupled at a second end to the plunger of the pneumatic cylinder. Preferably, a pair of parallel tracks or runners are included on the lower surface of the lid and engage the rollers on the second ends of the support brackets. The rollers preferably are rotatably mounted on a connecting rod or axle which extends between the rollers. An opening provided in the container lid accommodates a handle. A pair of wheels is preferably included adjacent an edge of the container lid.

The container lid of the invention is opened by applying a prying or opening force to the container lid by means of the attached handle, and thus to the support brackets, causing the support brackets to pivot relative to the base. As the support brackets pivot on the base from a closed position to an open position, the container lid is raised or elevated along one edge, while the other edge rests on the container opening. Once the support brackets have pivoted to the open position, the container lid may be easily rolled back on the rollers and wheels to open the container. The container lid itself does not undergo pivotal motion but is instead partially raised by the pivoting support brackets. Thus, a relatively small amount of force is required to open the container lid.

An object of the invention is to provide a container lid which allows facile opening and closing of heavy floor or ground mounted lids.

Another object of the invention is to provide a container lid which eliminates the risk of injury associated with handling of heavy lids.

Another object of the invention is to provide a container lid which does not include parts subject to frequent fatigue and failure.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
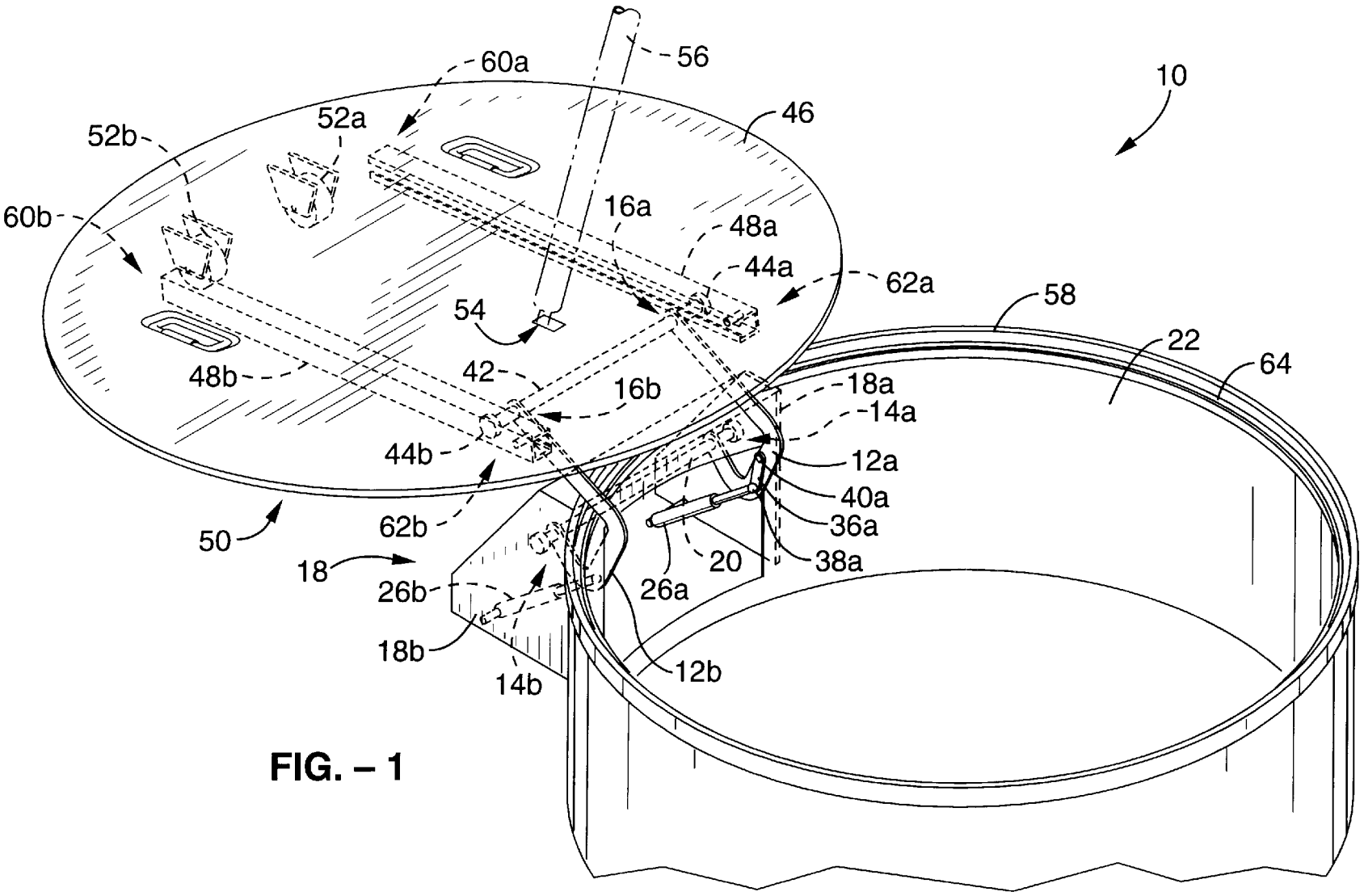
FIG. 1 is a perspective view of a container lid apparatus in accordance with the present invention shown in the open position.

Referring more specifically to the drawings, for illustrative purposes the present invention is embodied in the apparatus generally shown wherein like reference numerals denote like parts. It will be appreciated that the apparatus may vary as to configuration and as to details of the parts without departing from the basic concepts as disclosed herein. The present invention is disclosed in terms of use with a below ground container with the lid generally level with the ground or a floor surface. It should be readily apparent, however, that the container lid of the invention may be utilized with a variety of containers, tanks, storage vessels, drainage systems, or like structures.

Referring now to FIG. 1 through FIG. 5, a container lid apparatus 10 in accordance with the present invention is shown. The apparatus 10 includes a plurality of support brackets 12*a*, 12*b*, each of which has a first end 14*a*, 14*b* and a second end 16*a*, 16*b*, respectively. Support brackets 12*a*, 12*b* are pivotally coupled to the side walls 18*a*, 18*b* of base 18 at first ends 14*a*, 14*b*, respectively, preferably by a connecting rod or bolt 20 extending between walls 18*a*, 18*b* and through brackets 12*a*, 12*b* as shown, or by like hardware commonly used in the art. Connecting rod 20 is preferably welded or otherwise fixedly attached to brackets 12*a*, 12*b* but pivotally coupled to base side walls 18*a*, 18*b* using bearings or the like. Base 18 is connected to or otherwise associated with a supporting skirt 22 that fits into the hole in which a container is placed (not shown). While support brackets 12*a*, 12*b* are shown as a pair, a larger number of support brackets or a single support bracket may be utilized depending upon the particular application of the invention. Support brackets 12*a*, 12*b* preferably have a generally J-shaped configuration, but other structures and configurations for support brackets 12*a*, 12*b* are also contemplated for use with the invention. Support brackets 12*a*, 12*b* include generally straight forward arms 24*a*, 24*b*, respectively, as more fully described below.

Pneumatic or hydraulic shock-absorbing cylinders 26*a*, 26*b* are preferably employed in association with support brackets 12*a*, 12*b*, respectively. Pneumatic cylinders 26*a*, 26*b* are pivotally mounted to side walls 18*a*, 18*b* of base 18 by bolts or rods 28*a*, 28*b* adjacent first ends 30*a*, 30*b* of pneumatic cylinders 26*a*, 26*b*, respectively. Plungers or pistons 32*a*, 32 are slidably associated with pneumatic cylinders 26*a*, 26*b* and extend from second ends 34*a*, 34*b* of pneumatic cylinders 26*a*, 26*b* and are pivotally coupled to braces 36*a*, 36*b* by pins or rods 38*a*, 38*b*, respectively. Braces 36*a*, 36*b* are pivotally coupled to support brackets 12*a*, 12*b* by pins or rods 40*a*, 40*b*, respectively. Other standard shock absorbing means may alternatively be utilized with the invention in conjunction with one or both of support braces 12*a*, 12*b*.

Second ends 16*a*, 16*b* of support brackets 12*a*, 12*b* are pivotally coupled to a roller assembly comprising a connecting rod or axle 42 and rollers or casters 44*a*, 44*b* which are rotatably mounted on axle 42. Container lid 46 includes a plurality of tracks or runners 48*a*, 48*b* on a lower surface 50, with runners 48*a*, 48*b* engaging rollers 44*a*, 44*b* respectively. Container lid 46 is shown as a conventional round or disc shaped lid of heavy construction, preferably of steel or other metal or metal alloy in order to support the weight of persons or vehicles. Container lid 46, however, may be varied in structure and configuration as required. It is contemplated that additional tracks and rollers or a single track and roller, may be employed with the invention depending upon the number of support brackets required, the structure and configuration of container lid 46, and the particular application of the invention. One or more wheels or casters 52*a*, 52*b* are preferably included on a lower surface 50 of container lid 46 adjacent to the edge of container lid 46. An opening or bore 54 in container lid 46 is preferably provided to accommodate a handle 56.

Figure 2:
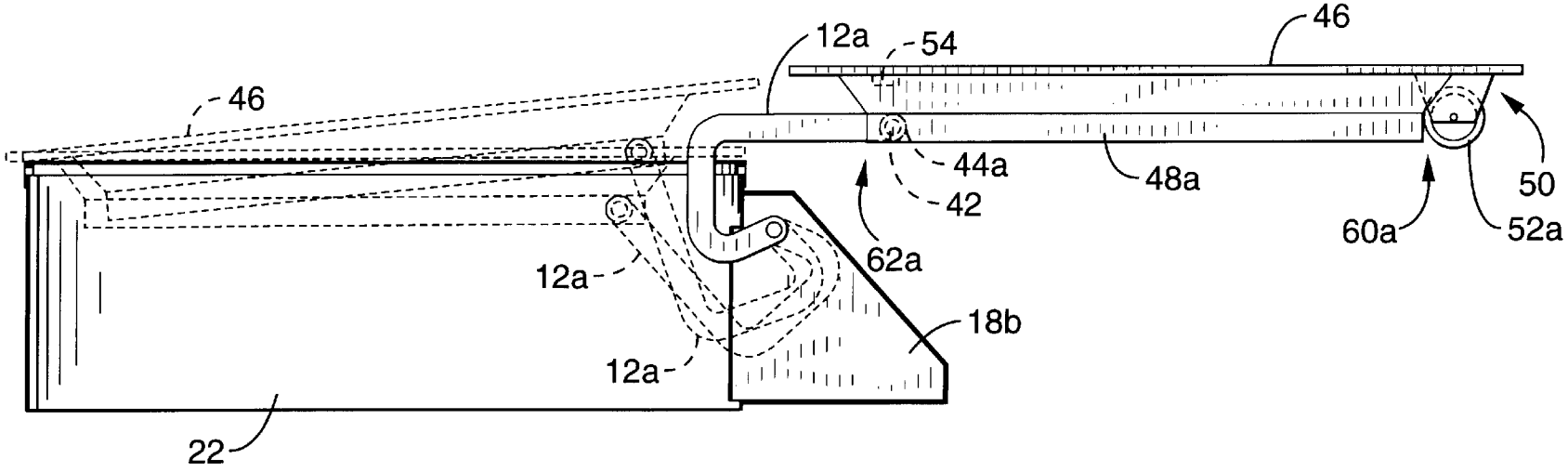
FIG. 2 is a cutaway side view of the container lid apparatus of FIG. 1 diagrammatically showing movement from an open to closed position.
Figure 3:
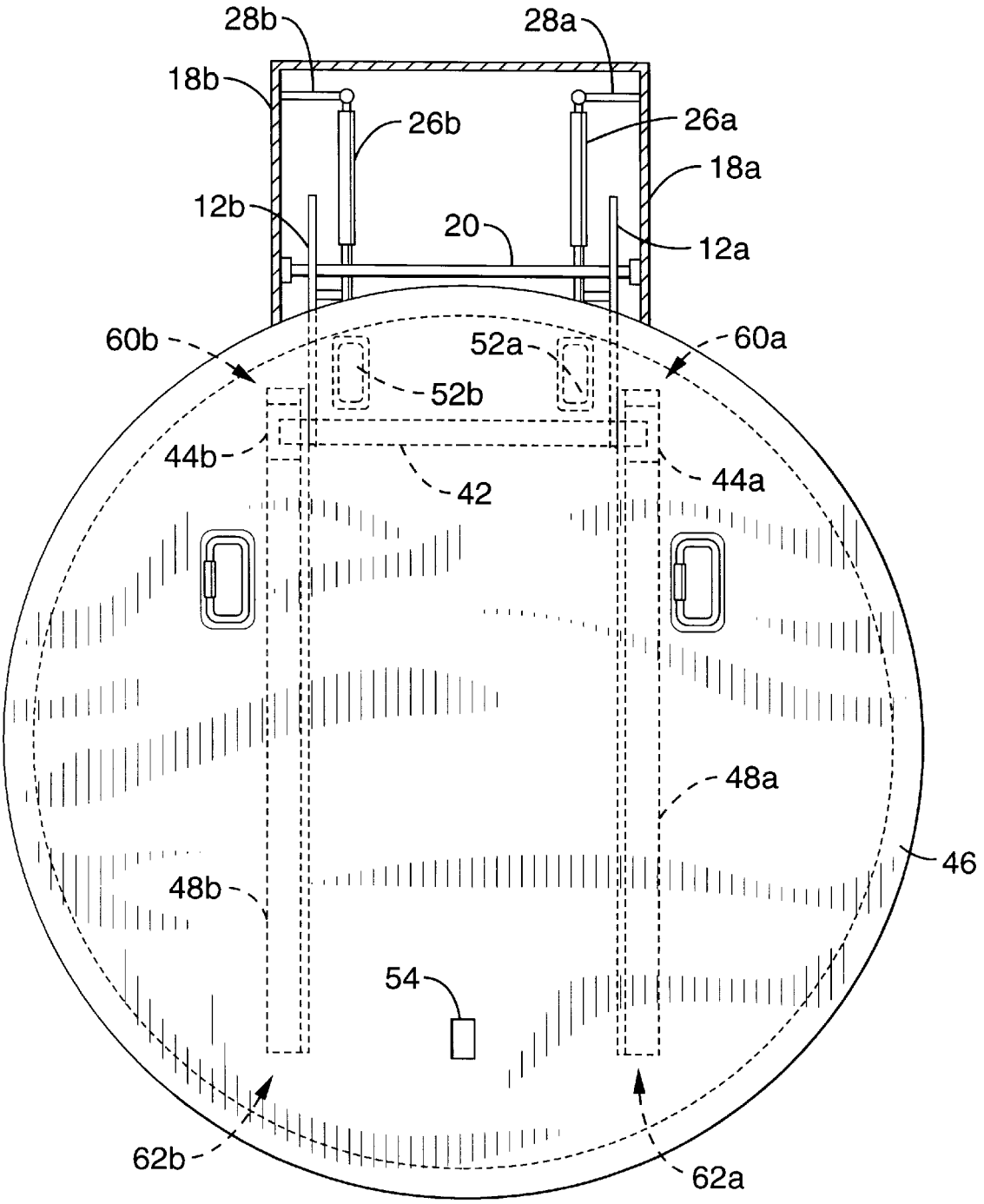
FIG. 3 is a top plan view of the container lid apparatus of FIG. 1 and FIG. 2 shown in a closed position.
Figure 4:
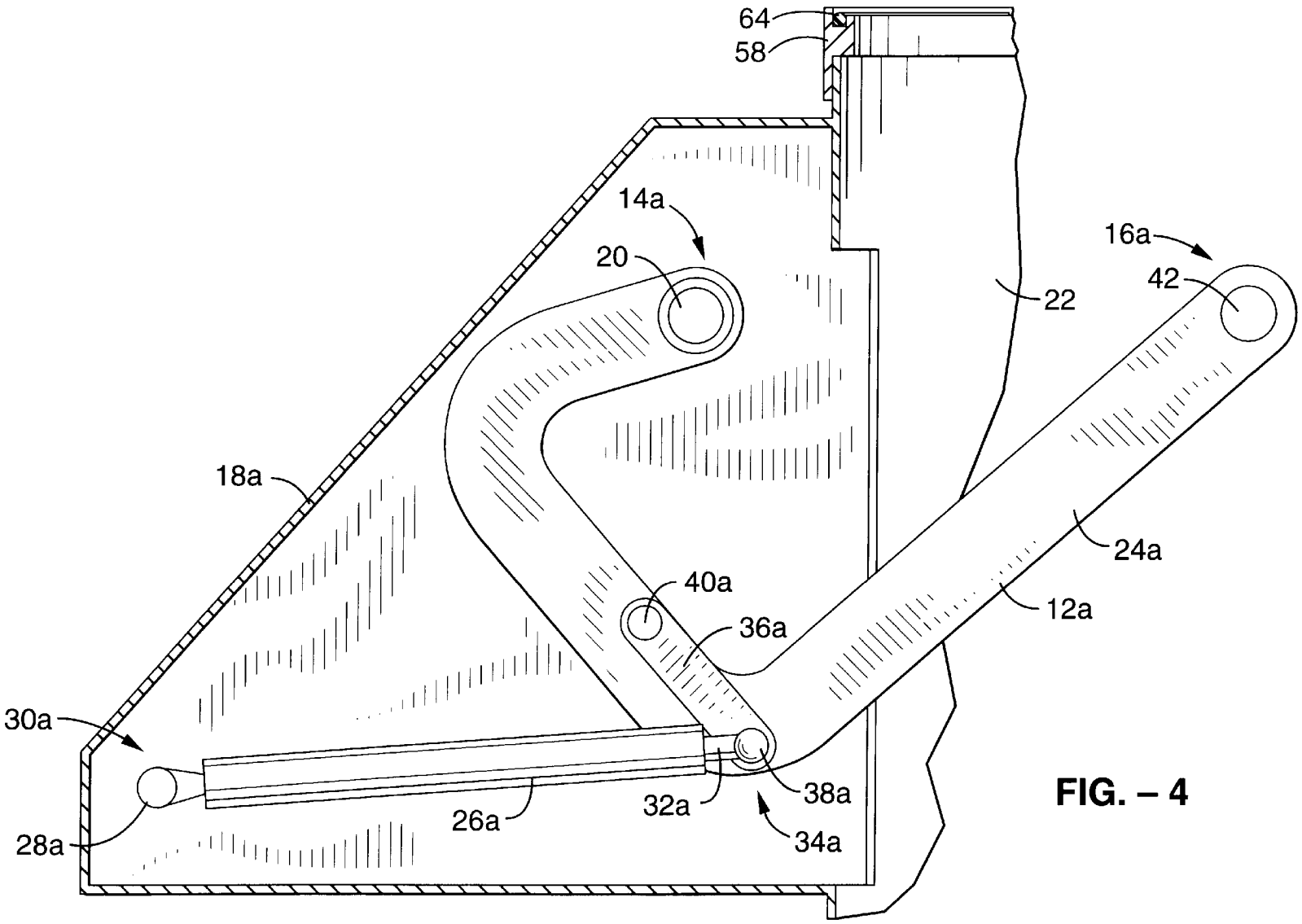
FIG. 4 is fragmentary side view of the bracket and skirt assembly of the container lid apparatus of the invention shown in the closed position.
Figure 5:
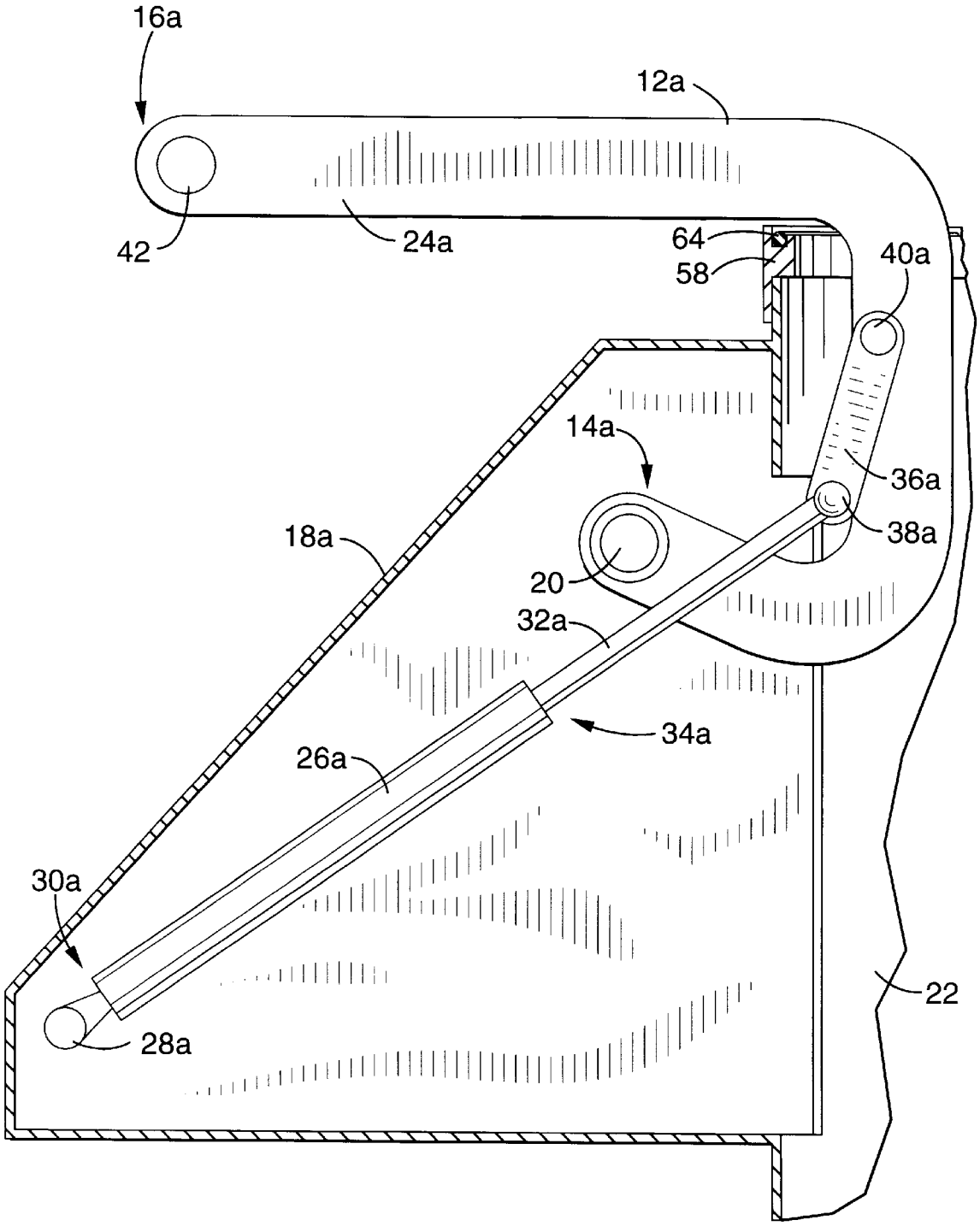
FIG. 5 is a fragmentary side view of the bracket and skirt assembly of FIG. 4 shown in the opened position.

In operation of the invention, support brackets 12*a*, 12*b* generally pivot about rod 20 in base 18 between a closed position and an open position, as can be seen most clearly by reference to FIG. 2, FIG. 4 and FIG. 5. Support brackets 12*a*, 12*b* generally undergo between approximately eighty degrees and one hundred and twenty degrees of rotation about rod 20 in moving between the open and closed positions, although this range of pivotal motion will vary depending upon the structure and configuration of support brackets 12*a*, 12*b* and the manner in which they are pivotally coupled to base 18 and rollers 44*a*, 44*b*.

In the closed position support brackets 12*a*, 12*b* are positioned such that second ends 16*a*, 16*b* are positioned below the lip 58 of skirt 22 with forward arms 24*a*, 24*b* oriented at approximately forty five degrees of angle relative to container lid 46, while pistons 32*a*, 32*b* are retracted within pneumatic cylinders 26*a*, 26*b*, respectively, and pneumatic cylinders 26*a*, 26*b* are in a substantially horizontal position. Container lid 46 is engaged within the lip 58 of skirt 22 such that the container (not shown) is closed or sealed. Rollers 44*a*, 44*b* and axle 42, while in the closed position, are generally adjacent to first ends 60*a*, 60*b* of tracks or runners 48*a*, 48*b* respectively.

In the open position second ends 16*a*, 16*b* of support brackets 12*a*, 12*b* are positioned above container lip 58, and forward arms 24*a*, 24*b* of support brackets 12*a*, 12*b* are in a substantially horizontal position, with piston 32 extended from pneumatic cylinder 26. Rollers 44*a*, 44*b*, while in the open position, roll within runners 44*a*, 44*b* from first ends 60*a*, 60*b* of tracks 44*a*, 44*b* to second ends 62*a*, 62*b*, as discussed further below. Bolts or other retention means (not shown) may be included at first ends 60*a*, 60*b* and second ends 62*a*, 62*b* of runners 48*a*, 48*b* to prevent rollers 44*a*, 44*b* from becoming disengaged from runners 48*a*, 48*b*.

To open the container lid 46 of the apparatus 10 while the container lid is in the closed position, handle 56 is inserted into opening 54 in container lid 46, and a force is applied via handle 56 to container lid 46 to rotate or pivot support brackets 12*a*, 12*b* about rod 20. As support brackets 12*a*, 12*b* pivot from the closed position towards the open position, pistons 32*a*, 32*b* extend from pneumatic cylinders 26*a*, 26*b*, respectively, while braces 36*a*, 36*b* pivot in a direction generally opposite to that of support brackets 12*a*, 12*b*. While support brackets 12*a*, 12*b* thus pivot about rod 20, rollers 44*a*, 44*b* and container lid 46 pivot relative to second ends 16*a*, 16*b* of support brackets 12*a*, 12*b*, and the portion of container lid 46 adjacent first ends 60*a*, 60*b* of runners 48*a*, 48*b* is raised from the lip 58 of skirt 22. When support brackets 12*a*, 12*b* have moved or pivoted about rod 20 to the open position, container lid 46 may be rolled on rollers 44*a*, 44*b* away from skirt 22, by applying suitable force via handle 56, to provide access to the container. Wheels 52*a*, 52*b* allow container lid 46 to roll across the ground or floor surface as rollers 44*a*, 44*b* roll or move within tracks 48*a*, 48*b* from first ends 60*a*, 60*b* towards second ends 62*a*, 62*b* of tracks 48*a*, 48*b*.

The container lid apparatus 10 is closed by generally reversing the above procedure. Force is applied to container lid 46 via handle 56 to move rollers 44*a*, 44*b* from second ends 62*a*, 62*b* to first ends 60*a*, 60*b* of runners 48*a*, 48*b* respectively, and to pivot support brackets 12*a*, 12*b* from the open position to the closed position, allowing container lid 46 to settle within skirt 22 and seal or close the container. Container lid 46 may alternatively be closed by applying force thereto by a person's foot. Pneumatic cylinders 26*a*, 26*b* also prevent container lid 46 from slamming upon closing.

Since container lid 46 is only raised a small amount during opening, and the weight of container lid is partially supported by skirt 22, only a relatively small force is required to open the container lid 46 of the present invention. Once in the open position, forward arms 24*a*, 24*b* of support brackets 12*a*, 12*b* are substantially parallel with roller tracks 48*a*, 48*b*, which facilitates the rolling of container lid 46 away from skirt 22 by rollers 44*a,* 44*b* as described above. Thus, the container lid apparatus 10 allows facile opening and closing of heavy container lids, and provides a clean seal between the container lid 46 and skirt 22. If desired, a rubber o-ring 64 or the like can be included. Note also that persons using the invention are not subject to back injury in moving container lid 46, and the risk of hand injury is greatly reduced since it is not necessary to directly grasp container lid.

The present invention is particularly suitable for use with openings in below ground storage tanks, containers, silos, railroad tank cars, tanker trucks, drainage systems, and like structures wherein a lid of heavy construction is used.

Accordingly, it will be seen that this invention provides a container lid apparatus which allows facile opening and closing of heavy container lids, and which eliminates the risk of injury associated with the handling of heavy container lids. Although the description above contains many specificities, these should not be construed as limiting the scope of the invention but as merely providing illustrations of some of the presently preferred embodiments of this invention.

I claim:

1. A sealing lid apparatus for a subsurface container, comprising:

(a) a lid;

(b) a track coupled to said lid;

(c) a bracket;

(d) a roller pivotally and slidably coupled to said bracket, said roller engaging said track; and (e) pivotal support means for coupling said bracket to a subsurface container, wherein said track slides along said roller and said bracket pivots about said support means and said track moving said lid between a first open position and a second closed position in said container.

2. A sealing lid apparatus as recited in claim 1, wherein said pivotal support means comprises:

(a) a pair of side walls;

(b) a connecting rod extending between said side walls, said bracket coupled to said connecting rod; and (c) shock-absorbing means for dampening pivotal motion of said bracket.

3. A sealing lid apparatus as recited in claim 2, wherein said shock-absorbing means comprises a fluid actuated cylinder.

4. A sealing lid apparatus for a subsurface container, comprising:

(a) a lid, said lid including at least one track disposed thereon;

(b) a base member, said base member being disposed within an opening of a subsurface container;

(c) a skirt member coupled to said base member, said skirt member positioned in said opening of the subsurface container; and (d) a support bracket including a first end and a second end, said first end of said support bracket pivotally coupled to said base member and a second end of said support bracket coupled to a roller, wherein said roller pivotally and slidably engages said track on said lid, whereby the pivoting of said bracket and the sliding of said track along said roller moves said lid between a first open position and a second closed position in said container.

5. An apparatus as recited in claim 4, further comprising shock-absorbing means for dampening pivotal motion of said bracket, said shock-absorbing means coupled between said base member and said support bracket.

6. A sealing lid apparatus for a subsurface container, comprising:

(a) a lid, said lid including a pair of track members disposed thereon;

(b) a base member, said base member being positioned within an opening of a subsurface container;

(c) a skirt member coupled to said base member, said skirt member placed in said opening of a subsurface container;

(d) a pair of support brackets, said support brackets each including a first end and a second end, said first end of each said support bracket pivotally coupled to said base member and said second end of each said support bracket coupled to a roller, wherein said rollers pivotally and slidably engage said track members on said lid, whereby the pivoting of said brackets and the sliding of said tracks along said rollers moves said lid between a first open position and a second closed position in said container; and (e) shock-absorbing means for dampening pivotal motion of said brackets.

7. An apparatus as recited in claim 6, further comprising a connecting rod extending between said support brackets.

8. An apparatus as recited in claim 6, further comprising an O-ring disposed around said skirt member, said O-ring providing a substantial seal between said lid and said skirt member when said lid is in said second closed position.

9. An apparatus as recited in claim 6, wherein said shock-absorbing means comprises fluid actuated cylinders coupled between said base member and said support brackets.

10. An apparatus as recited in claim 6, further comprising at least one wheel disposed on said lid to facilitate sliding said lid along the ground.

* * * * *